US009290247B2

(12) United States Patent
Doig

(10) Patent No.: US 9,290,247 B2
(45) Date of Patent: Mar. 22, 2016

(54) CARRIAGE-ON-TRACK SYSTEM FOR USE IN WINCHING LOADS

(71) Applicant: Daniel Doig, Innisfil (CA)

(72) Inventor: Daniel Doig, Innisfil (CA)

( * ) Notice: Subject to any disclaimer, the term of this patent is extended or adjusted under 35 U.S.C. 154(b) by 141 days.

(21) Appl. No.: 14/152,996

(22) Filed: Jan. 10, 2014

(65) Prior Publication Data

US 2015/0197322 A1 Jul. 16, 2015

(51) Int. Cl.
*B63C 3/08* (2006.01)
*B63C 3/12* (2006.01)
*B63C 3/02* (2006.01)

(52) U.S. Cl.
CPC ... *B63C 3/12* (2013.01); *B63C 3/02* (2013.01); *B63C 3/08* (2013.01)

(58) Field of Classification Search
CPC ..... B63C 3/08; B63C 3/02; B63C 3/12; B63C 3/00; B63C 3/06; B63C 3/14
USPC ..... 405/1, 2; 114/44; 187/245; 104/69, 70, 104/72, 73, 106, 107, 108, 111, 173.1, 174
See application file for complete search history.

(56) References Cited

U.S. PATENT DOCUMENTS

| | | | | |
|---|---|---|---|---|
| 3,833,032 | A * | 9/1974 | Hnot | 141/232 |
| 7,107,726 | B1 * | 9/2006 | Leslie et al. | 52/95 |
| 2004/0126185 | A1 * | 7/2004 | Davidson et al. | 405/7 |
| 2010/0189502 | A1 * | 7/2010 | Basta et al. | 405/3 |
| 2011/0243663 | A1 * | 10/2011 | Smith | 405/3 |
| 2013/0011187 | A1 * | 1/2013 | Schuit et al. | 403/287 |
| 2013/0146426 | A1 * | 6/2013 | Dhond et al. | 198/835 |

* cited by examiner

*Primary Examiner* — Sean Andrish
(74) *Attorney, Agent, or Firm* — Stuart L. Wilkinson

(57) ABSTRACT

A carriage-on-base system for use in winched movement of a load, the carriage shaped to support a load to be winched along the base, the carriage having a plurality of depending housings, a plurality of slider of ultra-high molecular weight polyethylene (UHMWPE) fixed in respective housings, the base having rails engaged by the sliders with lower surface profiles of the sliders matched to upper surface profile of the rails which they engage, the profiles of the rails and the sliders at their interengagement preventing any movement of the carriage relative to the rails other than sliding movement of the carriage along the rails.

13 Claims, 4 Drawing Sheets

CARRIAGE-ON-TRACK SYSTEM FOR USE IN WINCHING LOADS

FIELD OF THE INVENTION

This invention relates to a carriage-on-track system for winching loads and has particular but not exclusive application for moving loads such as small powered or unpowered water craft up and down an inclined slope for launching the craft from land into water and for retrieving the craft from water onto land.

DESCRIPTION OF RELATED ART

Known carriage-on-track systems include lake or marine systems having a base which is installed at the water's edge so that its upper end is located on land at a position where the water craft is to be parked when not in use, and its lower end is located in the water where the craft can be floated off and used. The carriage, with the craft supported upon it, is moved up the track using a winch and cable sub-system. It is moved down the track by releasing the winch and allowing the track to move under its own weight down the track. In one form of carriage-on-track system, sometimes referred to as a marine railway, the base has rails and the carriage has wheels or rollers and the carriage is moved along the track by the rollers rotating over the rails.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
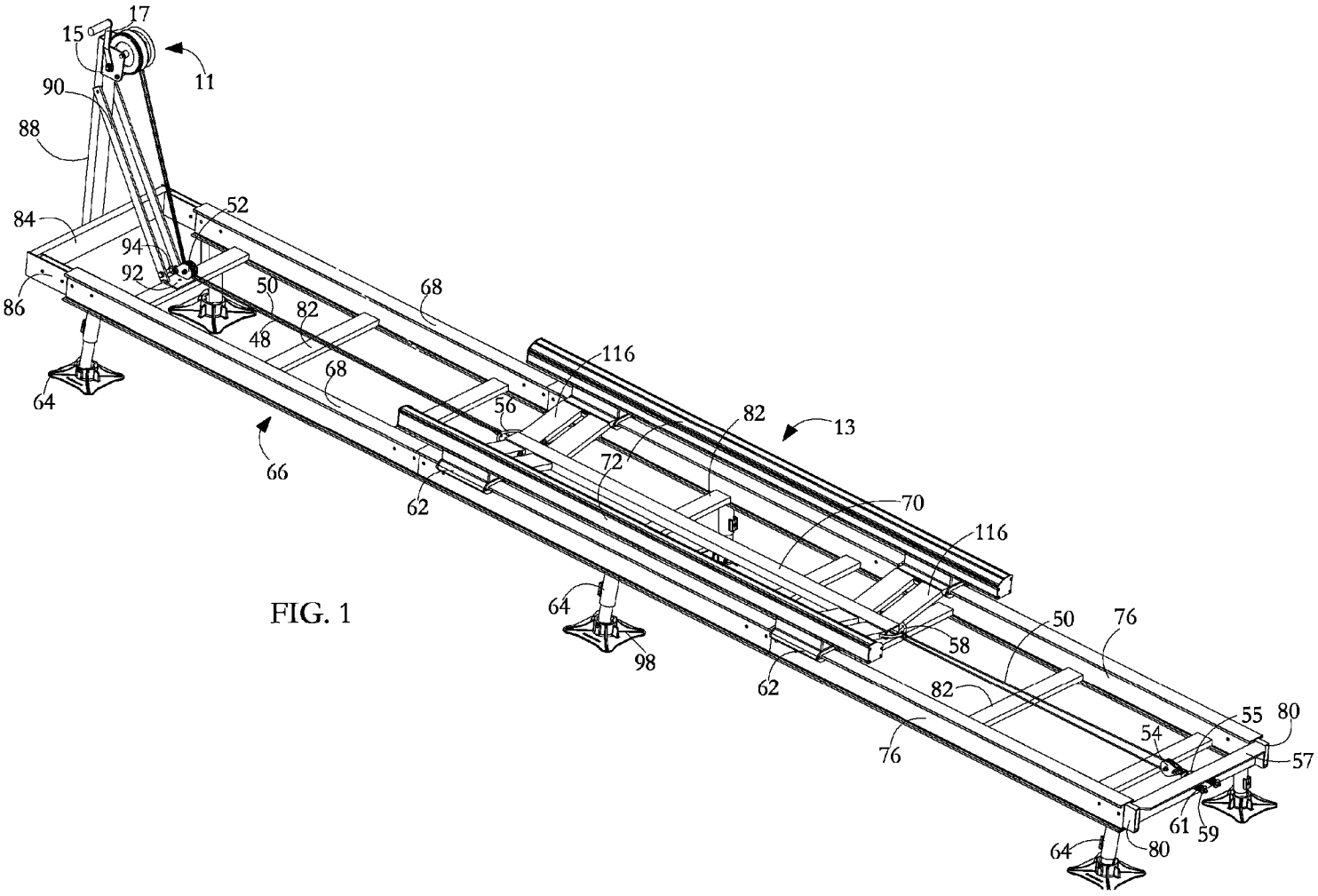
FIG. 1 is an isometric view of a carriage-on-track system according to an embodiment of the invention.

Referring in detail to FIG. 1, there is shown in isometric view a carriage-on-track system having a carriage 13 and a track 66. The carriage 13 slides over rails 68 of the track by means of slider assemblies 62 mounted to the carriage 13, the assemblies 62 having sliders engaging the rails 68, the sliders being hidden from view in FIG. 1 but shown in FIGS. 2 to 4. The track 66 is inclined downwardly towards the right so that the carriage 13 slides along and up the track towards the left and slides along and down the track towards the right. The carriage 13 forms a part of a load, with the carriage 13 typically supporting a vehicle or other item (not shown), such as a personal water craft. In this example, the personal water craft is presumed to be near or in water and is to be retrieved by winch action along and up the railed track towards a winch 11, or the craft is positioned over land and is to be launched along and down the railed track away from the winch.

In one exemplary embodiment, the carriage 13 is configured and dimensioned to support a particular craft, or range of craft, such as a Sea-Doo (®-Bombardier Recreational Products), a popular, small, self-propelled, one or two person water craft.

The carriage 13 is moved by means of a retrieve cable 48 and a launch cable 50 which turn on a drum forming part of the winch 11. In this specification, the term "retrieve", in relation to movement of a load, means movement of the load towards the winch 11. The term "launch" means movement of the load away from the winch 11, regardless of whether a conventional launch is to be effected. An exemplary form of winch for use with retrieve and launch cables is shown in exploded view in FIG. 5 and the illustrated carriage-on-track system is described in relation to using this winch. However, the carriage-on-track system can be used with other forms of winch.

The retrieve cable 48 extends down from the winch, passes round one of two routing sheaves 52, and has its end anchored to the front of the carriage 13. The launch cable 50 extends down from the winch 11, passes around passes round the other of the two routing sheaves 52, passes around a reversing sheave 54 mounted at the far end of the track, and has its end attached to the back of the carriage at an anchor formed at U bolt 58 which is bolted into a pair of carriage struts 116. The sheave 54 is mounted to a U bolt 55 that has bolt sections extending through a track support bar 57. The bolt sections are retained in the support bar 57 by nut/washer combinations 59 engaging with screw threaded ends of the bolt sections, the nut/washer combinations being spaced from the flange by compression springs 61.

In use, the carriage 13, together with the load that it supports, is pulled towards the winch 11 by clockwise turning of the winch handle 17. It is allowed to move down the carriage away from the winch under its own weight by releasing a brake at the winch and reverse turning the winch handle 17. In the winch example to be described presently, the cables 48 and 50 are moved in concert with the retrieve cable 48 being paid out as the retrieve cable is pulled in, and vice versa. In the retrieve mode and in the launch mode, as long as the load is "hanging" on the retrieve cable 48, the launch cable is rendered taut by the springs 61 but does not act to pull the carriage 13 down the track. However, in launch mode, the launch cable 50 acts to pull the carriage down the inclined track if movement of the carriage on the track stalls as the retrieve cable 48 is being let out.

The track is constructed so the rails 68 are accurately parallel. The rails are I-beam aluminum extrusions each having the cross sectional form shown in FIGS. 2, 3 and 5, the upright web element 76 of the I-beams being hollow. Close fitting rectangular joining members are inserted into respective beams at one end and are bolted or welded thereto with a tongue portion 80 of the joining members projecting out of the end of the element 76. The tongue portions 80 are used in one implementation for constructing longer concatenated tracks by connecting the tongue portion 80 of one beam pair into the open beam ends of another beam pair. The hollow web elements 76 of the I-beam structures also facilitate assembly of end pieces for the track as will be described presently.

The two I-beams of the track shown in FIG. 1 are connected by struts 82 which have their ends welded to the web sections 76 of the I-beams. The struts 82 are generally equispaced along the length of the beam pair (or along a lengthened structure when first and second beam pairs are concatenated together as shown in FIG. 1). At the winch end of the track, an end bar 84 has projecting parts 86 bolted into the open end portions of the web elements 76. A vertical mounting post 88 is bolted to the end bar 84. Near the top of the mounting post 88, brace members 90 are bolted to the post 88, the brace members 90 extending at an angle to join the nearest one of the struts 82 at their bottom ends. The brace member bottom ends are welded to an angle bar 92 which is fitted against the corner of the near strut 82 and welded to it.

The winch 11 is mounted in a frame 15 bolted to the top of the mounting post 88. A pin 94 is mounted to the brace member 90 near its lower end and the sheave 52 is mounted on the pin. In operation, as shown in FIG. 1, the retrieve cable 48 extends from the winch 11 and is fixed at an anchor point at the front of the carriage, the anchor point formed by a U bolt 56 having bolt sections extending though carriage struts 116, with the anchor site provided by the curved section of the U bolt.

At the far end of the track from the winch 11, rear angle bar 57 is fixed between the projecting tongues 80. The U bolt 55 has bolt sections extending through a vertical flange part of the angle bar 57 which are retained by nut/washer combinations 59 engaging with screw threaded ends of the U bolt 55, the nut/washer combinations spaced from the flange by compression springs 61. This arrangement ensures that the launch cable, extending from the rear end of the carriage 13, through the sheave 54, and back to the winch as shown in FIG. 1 is held taut even when load-pulling tension is applied to the retrieve cable 48, because any slight tendency for the launch cable 50 to slacken is taken up by the springs 61. The accumulation of slack in the launch cable 50 would be problematic as it might interfere with hanging parts of the load. In operation, as shown in FIG. 1, the launch cable 50 extends down from part of the winch 11, through the guiding front sheave 52, and through a central tubular spine 70 forming part of the carriage, through the reversing sheave 54, and finally back to the anchor eye at the back of the carriage 13.

The concatenated beam structure is supported by legs 64 which are bolted at their top ends to the bottom of the I-beams and which have feet 98 at their bottom ends to engage whatever terrain the track rests upon. The legs 64 are telescopic which enables them to be lengthened and shortened to accommodate local contour so that the rail base can be erected to have a uniform slope from front to back.

The slider assemblies 62 will now be described in greater detail with reference to FIGS. 2 to 4. The four sliders assemblies are positioned in a rectangular array in the carriage 13. Sliders 74 (FIG. 3) are made of ultra-high molecular weight polyethylene (UHMWPE) As noted in the Wikipedia entry for this material, ultra-high-molecular-weight polyethylene has extremely long polymer chains, with a molecular mass usually between 2 and 6 million u (unified atomic mass units. A longer chain serves to transfer load more effectively to the polymer backbone by strengthening intermolecular interactions. This results in a very tough material with very high impact strength. UHMWPE is highly resistant to most corrosive chemicals, has extremely low moisture absorption and, particularly important for the current application, has a very low coefficient of friction. The material is self-lubricating and is highly resistant to abrasion. However, other slider materials of like properties such as nylon or acetal are contemplated.

Each of the sliders is mounted in a housing 100 made of extruded aluminum and shaped to fit relatively closely around the slider 74 so as, essentially, to wrap it. In the course of assembly, the slider 74 is maneuvered into its aluminum housing 100 and is prevented from sliding out by front and back retention plates 101 which are bolted to their respective housing 100 and which prevent any fore or aft movement of the slider when in use. For this purpose, the housing extrusions are made with part-circular slots 103 as shown in FIG. 4 (end plate 101 not shown). After the extrusion is cut to length, the slots 103 provide bores for attaching the end plates 101 by means of bolts (not shown) running from front to back of the housing 100 and associated locking nuts (not shown).

In one embodiment, the slider cross-section is a very close match for the housing aperture so that, in use, the slider 74 will not move vertically or laterally in the housing 100 when the carriage-on-track system is being used. The required close fit demands low tolerances on the slider and housing dimensions. In an alternative embodiment, for applications where some torsional twist of the carriage is expected, for example because of heavy load or where there may be some variation in spacing of the nominally parallel rails, the housing aperture and slider cross section are dimensioned to permit the slider to float vertically and laterally of the order of 0.6 inches, so as to accommodate such twisting or other minor distortion without the risk of a slider binding against a rail.

To facilitate entry of the slider into the housing 100 at assembly, corners of the slider 74 are beveled as are corresponding corners of the housing aperture. The fully enclosed nature of the sliders 74 means that they do not need to fixed by fixing devices which might otherwise penetrate or clamp the UHMW extrusion. Sites of any such penetration or clamping would subject the slider to local stresses and increase the risk of deformation or fracture when the system is in use.

Figures 4, 5:
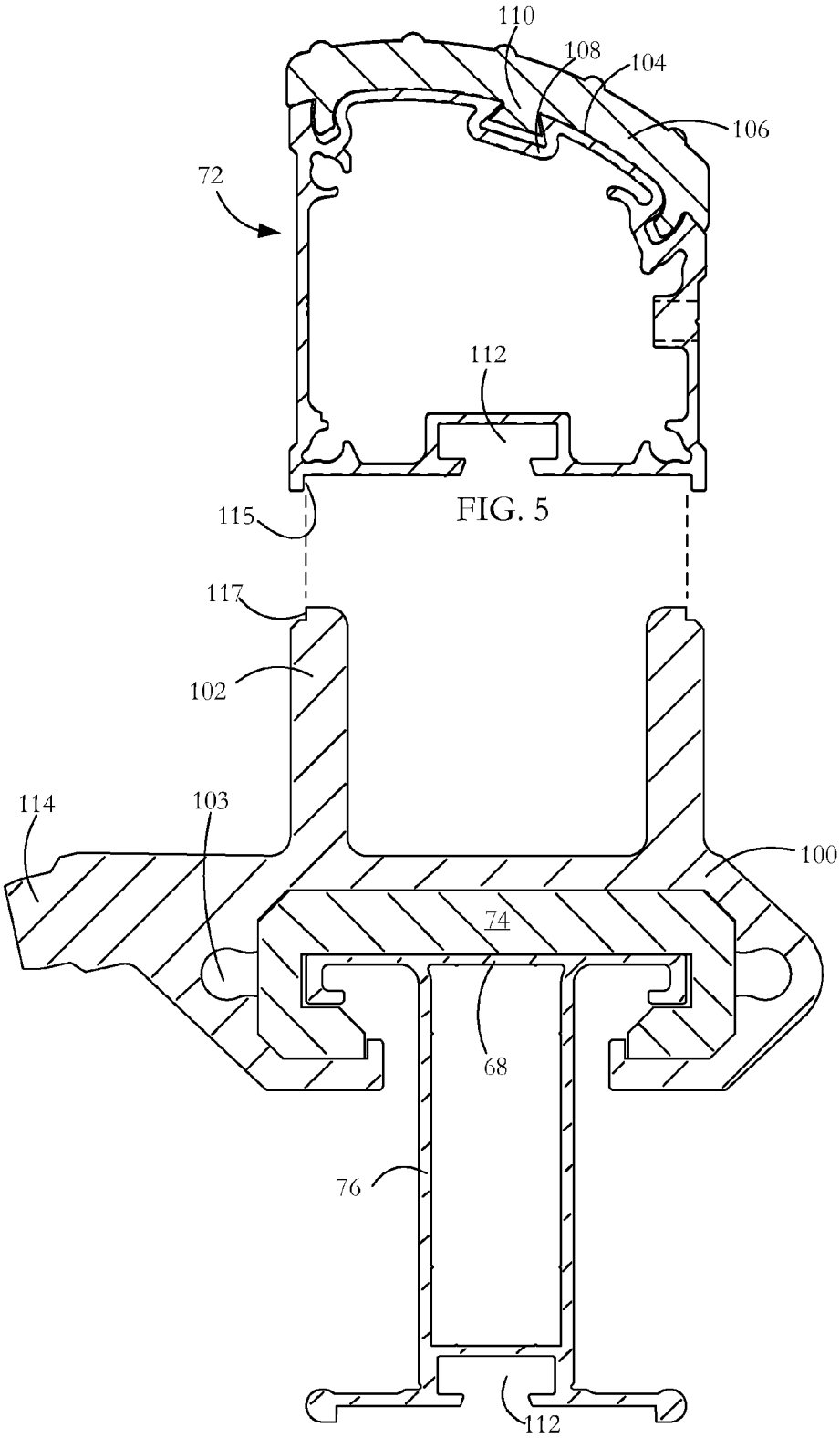
FIG. 4 is a cross-sectional view of the slider assembly and rail on the line A-A of FIG. 2.
FIG. 5 is a cross-sectional view of a bunk forming part of the carriage of the carriage-on-track system of FIG. 1.

As shown in the cross section of FIG. 4, the lower profile of the sliders conforms closely to the top profile of the rail 68. During assembly of the carriage 13 onto the track, the carriage 13 is slid from one end of the track by threading first one lateral pair of sliders 74 and then the other lateral pair of sliders 74 onto the one end of the parallel rail structure. Once the carriage is in place, the slider array distributes the weight of the carriage and the craft supported by it over the rail system.

Figure 2:
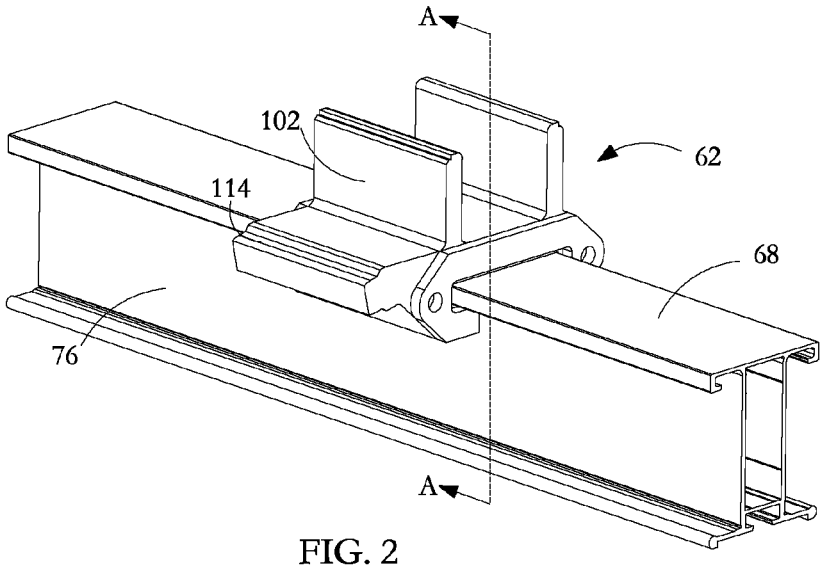
FIG. 2 is an isometric view of a slider assembly and rail forming part of the carriage-on-track system of FIG. 1.
Figure 3:
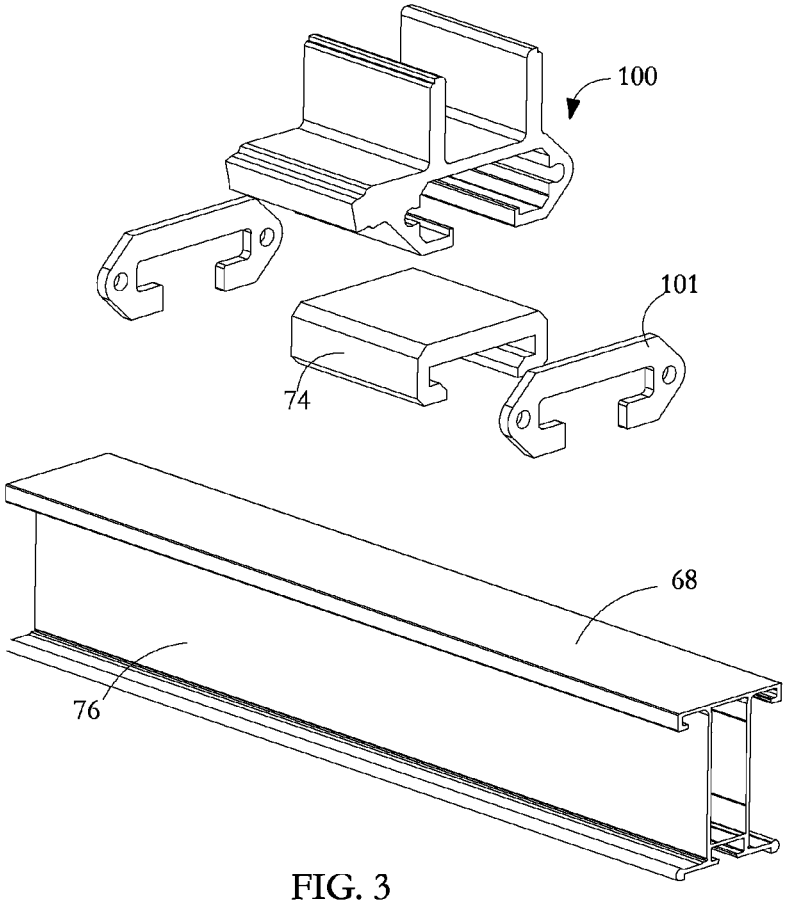
FIG. 3 is an isometric view of corresponding to FIG. 2 but showing the structural elements in exploded view.

As shown in FIGS. 2-4, slider housings 100 have parallel flanges 102 projecting up from the top surface for connection to elongate bunks 72 (FIG. 1) so that, following assembly, the bunks 72 extend from front to back at each side of the carriage 13. The bunks 72 are also aluminum extrusions, each having a cross sectional form as illustrated in FIG. 5. The upper surface 104 of the bunk extrusions face upwardly and slightly inwardly towards the center of the carriage so as to present a supporting surface generally orientated to the hull profile of the craft to be supported when it is seated in the carriage. This upper surface 104 is covered by a flexible cushioning layer 106 of polyethylene, carpet or like material to protect the hull surface of the craft being supported by the carriage. In the illustrated embodiment, the upper face 104 has re-entrant slots 108 to enable press fitting at the top surface, the flexible cushioning layer 106 having corresponding salient formations 110 on its contact surface to enable a snap fit. The lower face of the bunk extrusions also has a re-entrant configuration 112 allowing insertion of a fixture bolt into the re-entrant aperture. The fixture bolt (not shown) has an asymmetric head allowing the head of the bolt to be inserted and twisted whereby it is retained in the aperture for fixing to the top of the housing 100. At assembly, the bunks and the flanges are brought together and welded at locations 115, 117.

The housings 100 have spur formations 114 matched in shape and angle to the shape of hollow rectangular section struts 116 into which they are inserted and welded during construction to connect the bunks 72 and slider assemblies 62 on one side of the carriage 13 to those on the other side. A larger number of struts 116 can be used to support larger loads. At the lower center of the carriage, the struts 116 are welded to the central rectangular tube 70 through which the retrieve cable moves, the tube serving, in operation, to separate the retrieve cable 50 from anything hanging from the load being transported, such as a propeller or tie ropes.

Figure 6:
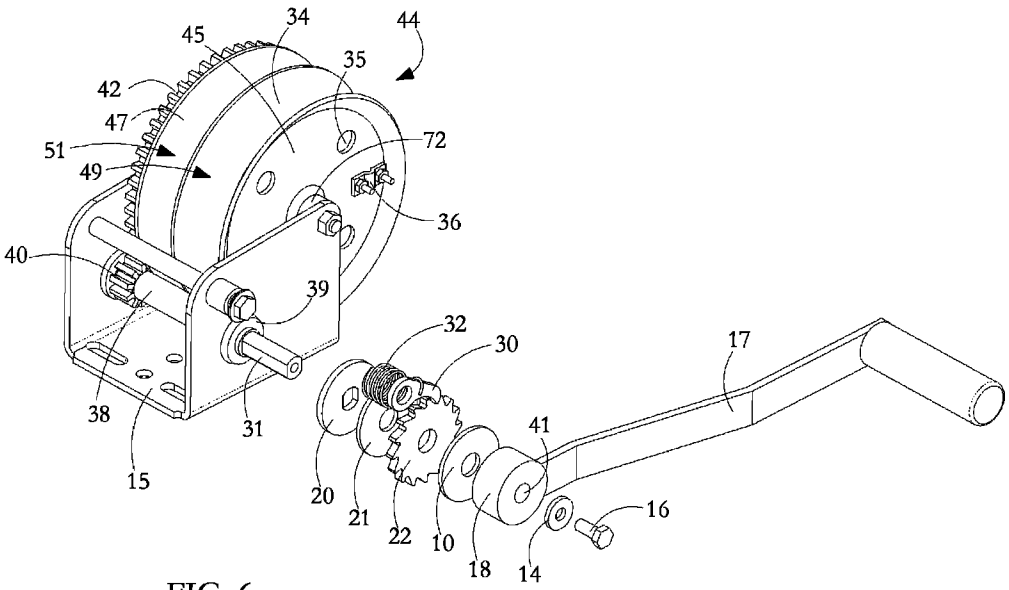
FIG. 6 is an isometric, exploded view of a winch of particular value for use in a carriage-on-track system according to an embodiment of the invention.

As previously indicated, carriage-on-track systems according to the invention are preferably used with so-called push-pull winches having both a launch cable and a retrieve cable (or a single cable having launch and retrieve ends). One such winch, having particular applicability to the present invention, is illustrated in FIG. 6. As shown in the exploded isometric view of FIG. 6, the winch has a frame 15 to which are mounted a pinion shaft 38 and a main shaft 72. A drum 44 is made integral with the main shaft 72 by welding or attachment. The drum 44 has flanking flanges 45, 47, a central divider plate 34 and a drive gear 42. Although not shown in FIG. 6, the retrieve cable is wound in one direction around part 49 of the drum between the flange 45 and the divider plate 34, and the launch cable is wound in the opposite direction around part 51 of the drum between the flange 47 and the divider plate 34. The retrieve cable projects through a hole 35 in the flange 45 and is anchored at a cable clamp arrangement 36. A similar arrangement is used to clamp the launch cable to the flange 47 (not shown).

Mounted on the pinion shaft 38 within the frame 15 is a pinion gear 40 which meshes with the drive gear 42. Turning the pinion shaft 38 causes the drive gear 42 and drum 44 to be turned to draw the retrieve and launch cables onto or off the drum 44 depending on the direction in which the drum is turned.

Mounted on the pinion shaft 38 outside the frame 15 are several elements which together constitute a winding mechanism and a brake mechanism. These elements include, in order of assembly from an outer end region of the pinion shaft 38, a crank handle 17 and hub 18, an outer drive disc 14, an outer friction disc 10, a ratchet wheel 22, an inner friction disc 21, and an inner drive disc 20. The ratchet wheel 22 engages with a pawl 30 mounted on the frame 15, with the pawl being spring biased by spring 32 into engagement with the teeth of the ratchet wheel 22.

The ratchet wheel 22 is free to rotate in a clockwise direction as shown in FIG. 6 by the pawl 30 riding up and over the ratchet wheel teeth but may be prevented from rotating in an anticlockwise direction by locking engagement of the pawl 30 between adjacent teeth of the ratchet wheel 22. A part of the pinion shaft 38 projecting from the frame 15 has opposed flats 31 and the drive disc 20 has an aperture matched to the cross-sectional shape of the pinion shaft 38 at the flats 31 so that the drive disc 20 and the pinion shaft 38 are constrained to turn together. The pinion shaft 38 has a shoulder 39 forming an abutment against which the drive disc 20 bears when the winch is in a braking mode as will be described presently.

The hub 18 has a central internally threaded bore and a projecting part of the pinion shaft 38 outside the frame 15 has a matching exterior thread, with the hub in screw engagement with the shaft projecting part. The hub 18 is free to rotate on the pinion shaft 38 between limiting positions which determine whether the winch operates in a launch or retrieve mode. Projecting into the end of the pinion shaft is a threaded bore 41. The outer drive disc 14 is retained next to the hub by a bolt 16 engaged in the bore 41. The threads of the bolt 16 and bore 41 are left hand threads so that anticlockwise turning of the handle 17 in launch mode will tend to tighten the bolt 16 in bore 41 rather than release it. The threads of the projecting portion of shaft 38 and the interior of hub 18 are conventional right hand threads. The crank handle 17 forms an integral structure with the hub 18 by being welded or mechanically fixed to it. The friction discs 10, 21, the drive disc 14, and the ratchet wheel 22 are not attached to the pinion shaft 38. They are mounted so as to permit rotation relative to the shaft 38 when the winch is operated in a launch mode. Such relative rotation is however prevented when the winch is operated in retrieve mode or in brake mode. A brake mechanism is engaged if turning of the handle 17 in either direction is halted by the operator and the handle is released. The brake mechanism is also automatically engaged if there is any sudden slippage of the load down the track when operating in launch mode, as will be described presently.

In retrieve mode, the handle 17 is turned clockwise around the axis of hub 18. In this mode, the threaded interior of the handle hub 18 is in screw engagement with the external threaded end portion of the pinion shaft 38, and the retrieve cable is in tension owing to the weight of the load "hanging" down the inclined slope. Initially, the drum 44 and the associated pinion shaft 38 are restrained from turning by the load imposed on the retrieve cable. Consequently, as the handle 17 is turned in the clockwise direction, the handle hub 18 screws along the pinion shaft 38 towards the drum 44 until it squeezes the two friction discs 10, 20, the ratchet wheel 22 and inner drive disc 22 together up against the shoulder 39 of the shaft 38. Once these elements are hard up against one another and the shoulder 39, subsequent clockwise turning of the handle 17 causes torque to be applied through the pinion shaft 38 and the winch drum 44, and the drum rotates in a anticlockwise direction to reel in the retrieve cable onto part 49 of the drum while paying out the launch cable from part 51 of the drum. Because the handle hub 18, the friction discs 10, 21, the ratchet wheel 22, the drive disc 20 and the pinion shaft 38 are clamped together, they function essentially as a single assembly locked to the pinion shaft. As the pinion shaft is driven in the retrieve direction, the spring biased pawl 30 moves over the ratchet wheel 22 allowing the retrieve and launch cables and the associated load to be moved in the retrieve direction but with the pawl 30 preventing movement of the cables and load in the launch direction: i.e. preventing any unintended "back driving" of the system while in retrieve mode. In the retrieve mode, the winch is driven solely by the clamping created by the handle hub 18 squeezing the friction discs 10, 21 and intermediate ratchet wheel 22 against the drive disc 20 and the shoulder 39 of the pinion shaft 38. In this mode, the tension in the retrieve cable is determined by the weight of the load acting down the inclined slope. Tension in the launch cable is lower and is determined by the action of the compression springs 61.

In contrast, in the launch mode, the crank handle 17 is turned anticlockwise. Initially, the retrieve cable may be under tension arising from "hanging" load and with the pawl 30 engaged by ratchet wheel 22. Alternatively, the load may be in a stalled position resting on the track and retained there under static frictional engagement between the load and the track.

The latter situation is often encountered by those using conventional winches in launch mode. In a conventional winch, with a retrieve cable and brake, but no launch cable, the load may simply sit when the winch handle is turned in reverse to release the brake. The cable slackens but the load does not move down the inclined slope to allow launch to occur. With brake release alone being insufficient to allow the load to start to move under its own weight, the winch operator may have to let go of the winch handle, go to the load and give it a push start along and down the track. If the launch is sufficient to release the load, it slides a small distance along the track under its own weight until the winch brake automatically engages. At this time, because the retrieve cable is now under load tension arising from the action of the weight component of the load, subsequent reverse turning of the winch handle to release the brake enables the load to move down the track under its own weight as the cable is paid out until the desired load position is reached or until a subsequent stall occurs. Once the load is at its desired position, the operator can cease anticlockwise turning of the winch handle.

In launch mode, because the internal thread on the handle hub 18 is in engagement with the external thread on the end portion of the pinion shaft 38, and the winch drum 44 including the pinion shaft 38 is restrained from turning by the "hanging" load, initial anticlockwise turning of the pinion shaft 38 causes the hub 18 to unscrew away from the drum 44 until the outside of the hub 18 runs up tight against the drive disc 14 under the head of bolt 16. Because further axial movement of the hub 18 along the pinion shaft 38 is prevented owing to the hub 18 abutting the drive disc 14, further turning of the handle 18 causes torque to be transmitted to the pinion shaft 38.

At this point, the retrieve cable may be under tension arising from action of the hanging load and with the pawl 30 engaged by ratchet wheel 22. Alternatively, the load may be in a stalled position on the track owing to static friction.

If there is no stall—for example, the slope is steep and the load "hangs" at the end of the retrieve cable—further anticlockwise turning of the handle 18 causes the retrieve cable to be paid out from part 49 of the drum 44 and the load moves down the inclined slope. Such anticlockwise turning simultaneously winds the launch cable onto part 51 of the drum. At this time the pawl and ratchet mechanism is ineffective because clamping pressure to lock the ratchet assembly against the shoulder 39 of the pinion shaft has been released. However, if the operator lets go of the handle 18, the hanging load acting through the retrieve cable causes the pinion shaft 38 and the hub 18 to screw together, clamp the ratchet assembly to the shaft, and so engage the brake.

If there is a stall—for example, the inclined slope is too gentle and there is static resistance to the load moving along and down the track, tension applied to the launch cable by anticlockwise turning of the handle 18 increases, tension in the retrieve cable being then determined by the action of the compression springs 61. As long as the static resistance is maintained, the load is dragged along and down the track by the launch cable. However, if the load starts to run down the track under its own weight, this results in a sudden increase in tension in the retrieve cable. This is transmitted through the drum 44 to the pinion shaft 38 to cause the shaft to turn relative the hub 18. This, in turn, causes the hub to move along the pinion shaft, to close the gap, and then to squeeze the hub, friction discs, ratchet wheel and drive disc 20 together against the shaft shoulder 39. At this point, the ratchet wheel 22 effectively becomes locked to the pinion shaft 38 and the engagement between the pawl and ratchet wheel halts any further uncontrolled rotation of the shaft 38. This acts to brake further rotation of the drum 44 and runaway movement of the load.

When the winch is being operated, whether in launch or retrieve mode to retrieve or launch the craft supported by the carriage 13, the carriage moves along the rails 68 up or down the inclined slope with the UHMWPE sliders offering a very low friction contact where they bear against the rails. With the matched profiles where the slider 74 and the rail 68 interface, unwanted relative lateral or vertical movement is prevented.

Other variations and modifications will be apparent to those skilled in the art. The embodiments of the invention described and illustrated are not intended to be limiting. The principles of the invention contemplate many alternatives having advantages and properties evident in the exemplary embodiments and as defined by the claims.

What is claimed is:

1. A carriage-on-base system, the carriage configured to support an item to be winched along the base, the carriage having a plurality of depending housings, and a plurality of sliders fixed in respective housings, the base having rails engaged by the sliders with lower surface profiles of the sliders matched to upper surface profile of the rails which the sliders engage, the profiles of the rails and the sliders at the engagement thereof preventing movement of the carriage relative to the rails other than sliding movement of the carriage along the rails, each of the sliders being a section of an extrusion, each section being fixed in the respective housing thereof solely by bounding parts of the housing.

2. A system as claimed in claim 1, the sliders made of ultra-high molecular weight polyethylene (UHMWPE).

3. The system as claimed in claim 1, the carriage having four sliders disposed in a rectangular array, the rails being two parallel rails with one pair of sliders in sliding engagement with one of the rails and the other pair of sliders in sliding engagement with the other rail.

4. The system as claimed in claim 1, further comprising end caps at the ends of each housing to hold the respective slider within the housing.

5. The system as claimed in claim 1, the housings having mounting structures projecting upwardly therefrom, the mounting structures having bunks attached thereto for supporting and guiding a load to be winched along the base.

6. The system as claimed in claim 5, the bunks being rigid extruded aluminum structures, a bearing surface of the structures being covered with a compressible material for protecting a lower surface of a load to be supported by the carriage.

7. The system as claimed in claim 1, the rails being of I-beam form, the upright of the I-beam being hollow, a tongue member fixed in an open end of at least one of the I-beam rails and having a projecting tongue for fixture within an open end of another I-beam to make a concatenated rail system.

8. The system as claimed in claim 1, the carriage having an anchor point at each of the front and rear ends thereof for attachment thereto of retrieve and launch cables.

9. A carriage-on-base system, the carriage configured to support an item to be winched along the base, the carriage having a plurality of depending housings, and a plurality of sliders fixed in respective housings, the base having rails engaged by the sliders with lower surface profiles of the sliders matched to upper surface profile of the rails, the profiles of the rails and the sliders at the engagement thereof preventing movement of the carriage relative to the rails other than sliding movement of the carriage along the rails, the housings having mounting structures projecting upwardly therefrom, the carriage being of generally V-form cross section, the mounting structures having first and second bunks attached thereto for supporting and guiding a load to be winched along the base, the first and second bunks located at respective extremities of the V, the carriage having supporting struts extending inwardly and downwardly from the housings to a central spine member of the carriage.

10. The system as claimed in claim 9, the spine member being hollow and accommodating a winch cable.

11. A carriage-on-base system, the carriage configured to support an item to be winched along the base, the carriage having a plurality of depending housings, and a plurality of sliders fixed in respective housings, the base having rails engaged by the sliders with lower surface profiles of the sliders matched to upper surface profile of the rails which the sliders engage, the profiles of the rails and the sliders at the engagement of the sliders with the rails preventing movement of the carriage relative to the rails other than sliding movement of the carriage along the rails, the sliders made of ultra-high molecular weight polyethylene (UHMWPE), the rails being of I-beam form, the upright of the I-beam being hollow, a tongue member fixed in the open end of at least one of the I-beam rails and having a projecting tongue for fixture within the open end of another I-beam to make a concatenated rail system, the base having a plurality of legs, the legs having feet at lower ends thereof and mounts at upper ends thereof connecting the legs to lower faces of the I-beam rails, the legs being telescopic to enable leg length adjustment.

12. A carriage-on-base system, the carriage configured to support an item to be winched along the base, the carriage having a plurality of depending housings, and a plurality of sliders fixed in respective housings, the base having rails engaged by the sliders with lower surface profiles of the sliders matched to upper surface profile of the rails which sliders engage, the profiles of the rails and the sliders at the engagement of the sliders with the rails preventing movement of the carriage relative to the rails other than sliding movement of the carriage along the rails, the carriage having an anchor point at each of the front and rear ends thereof for attachment thereto of retrieve and launch cables, further comprising a winch mounted on the base having the retrieve cable wound thereon in a first direction and the launch cable wound thereon in a second direction opposite to the first direction, the retrieve cable extending from the winch to the anchor point at a front end of the carriage, the launch cable extending from the winch to a guiding sheave on the base, from the guiding sheave to a second sheave near a rear end of the base and back from the second sheave to the anchor point at a rear end of the carriage.

13. The system as claimed in claim 12, further comprising a spring mechanism between the base and a mounting for the second sheave for maintaining the launch cable taut.

* * * * *